United States Patent [19]

Mahnke

[11] Patent Number: 4,546,970

[45] Date of Patent: Oct. 15, 1985

[54] WEIGHT TYPE EXERCISING DEVICE

[75] Inventor: Parker E. Mahnke, Studio City, Calif.

[73] Assignee: Marcy Gymnasium Equipment Co., Alhambra, Calif.

[21] Appl. No.: 447,239

[22] Filed: Dec. 6, 1982

[51] Int. Cl.[4] ..... A63B 21/06

[52] U.S. Cl. ..... 272/118; 272/134

[58] Field of Search ..... 272/118, 143, 136, 142, 272/DIG. 4, 93; D21/195, 196, 197, 191

[56] References Cited

U.S. PATENT DOCUMENTS

| | | | |
|---|---|---|---|
| 2,932,509 | 4/1960 | Zinkin | D21/195 X |
| 3,850,431 | 11/1974 | Winans | 272/118 |
| 4,093,213 | 6/1978 | Coker et al. | 272/118 |
| 4,257,593 | 3/1981 | Keiser | 272/143 |
| 4,311,305 | 1/1982 | Lambert et al. | 272/118 |
| 4,317,566 | 3/1982 | Uyeda et al. | 272/118 |

*Primary Examiner*—Richard J. Apley
*Assistant Examiner*—William R. Browne
*Attorney, Agent, or Firm*—James E. Brunton

[57] ABSTRACT

A resistance exercising machine having a similarly configured triangularly shaped main frame adapted to carry at least one stack of weights and a pivoted engagement mechanism which is operably coupled with the weights and is adapted to be engaged by the trainee to cause a controlled movement of the mechanism relative to the main frame against the urging of the weights.

3 Claims, 18 Drawing Figures

FIG. 1.
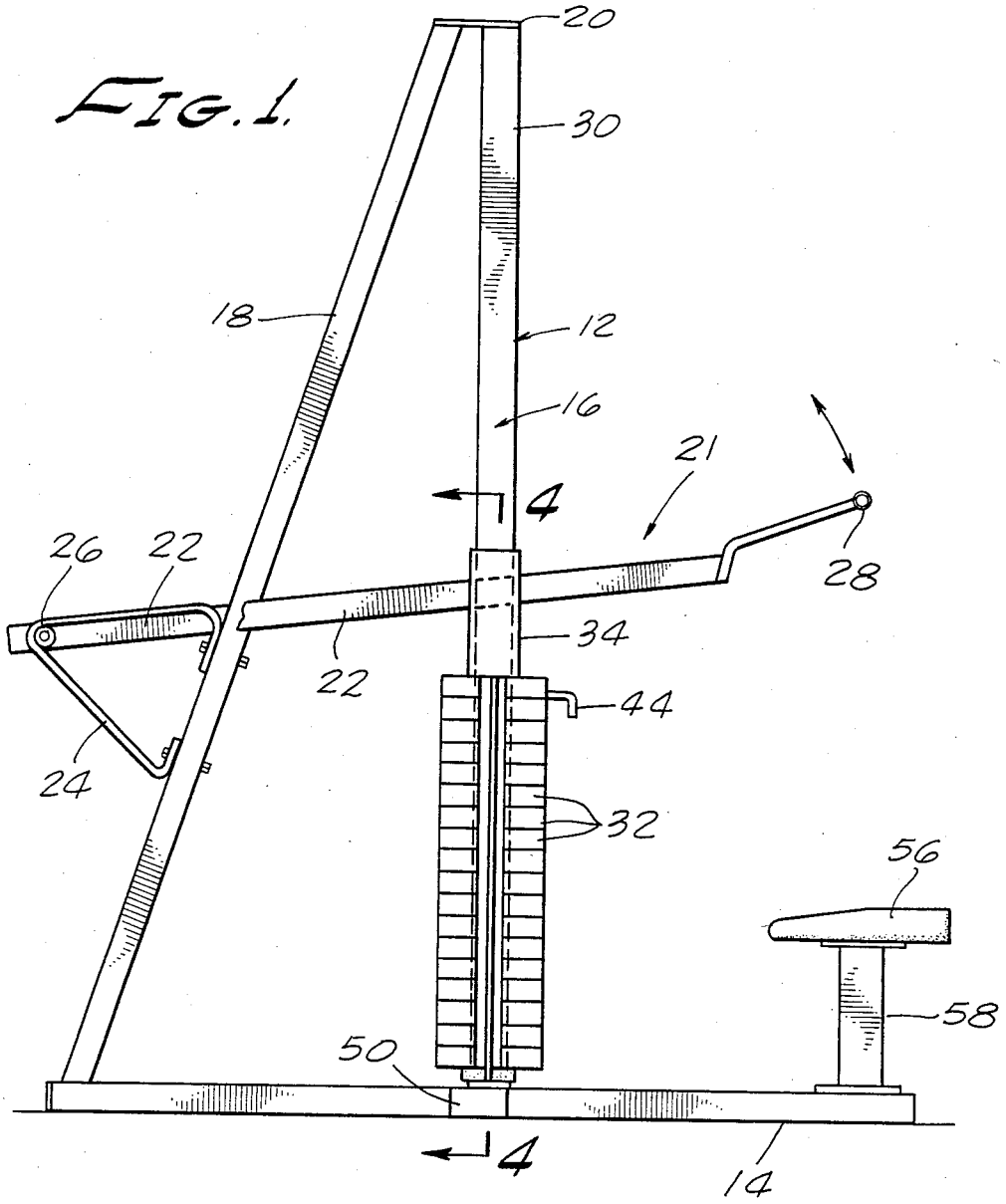
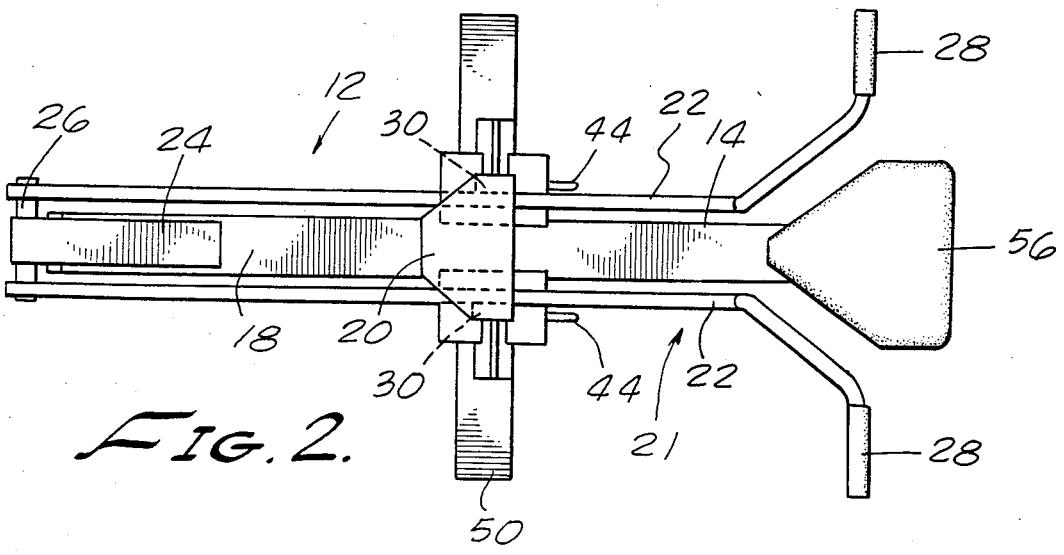
FIG. 2.

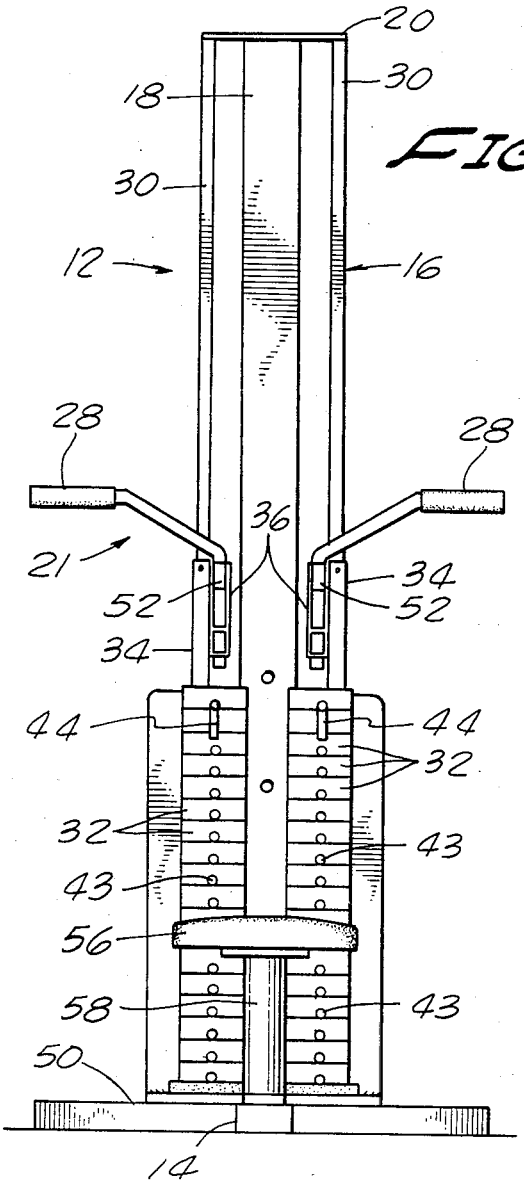
FIG. 3.
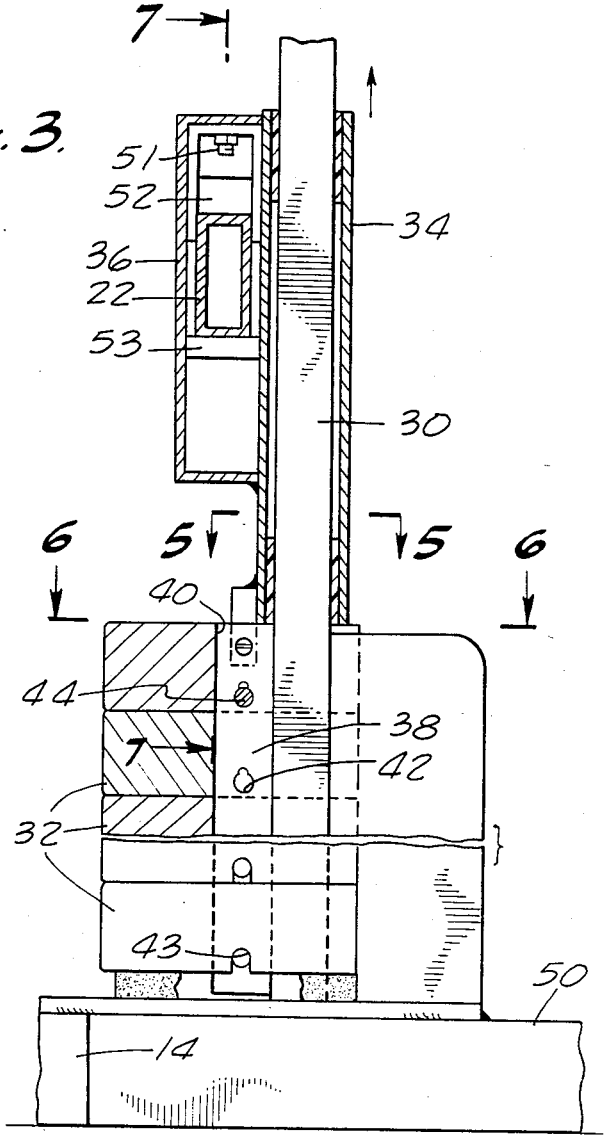
FIG. 4.
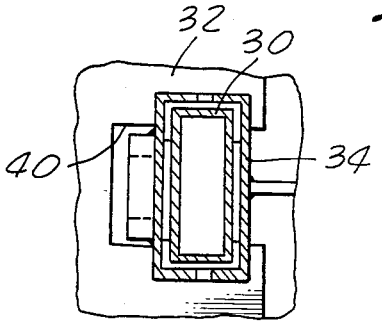
FIG. 5.
FIG. 6.
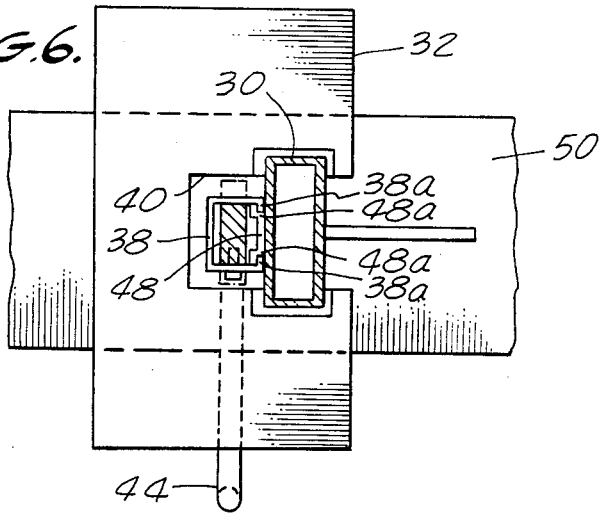

WEIGHT TYPE EXERCISING DEVICE

BACKGROUND OF THE INVENTION

1. Field of the Invention

The present invention relates to body exercising apparatus and more particularly to a family of exercising machines for exercising selected muscles of the body in a safe and controlled manner so as to avoid injury to the user of the apparatus.

2. Discussion of the Prior Art

Progressive resistance exercises for therapeutic and rehabilitative purposes have become extremely popular in recent years. The value of regular exercise in preventing illness and in improving physical appearance has become well recognized and has stimulated a demand for new and improved progressive resistance exercising equipment. In response to this demand a wide variety of different types of equipment has been suggested for exercising each of the major muscle groups of the body.

Because of the differing requirements for exercising the various muscle groups of the body, many specialized, single purpose devices have been developed. For example, specialized equipment has been designed for exercising the legs. Other, and different, equipment has been devised for exercising the arms and shoulders. Still other devices have been suggested for exercising back and neck muscles. In short, a great number of differently configured and dissimilarly constructed machines are now being offered for sale. Because of the great differences between the various machines, their cost of manufacture is extremely high, maintenance is difficult and a very large amount of floor space is needed to set up and use the machines.

In the apparatus of the present invention the aforementioned drawbacks of the prior art devices are uniquely overcome through standardization of the main frame, or major structural component of the apparatus. Through the use of a standardized main frame for carrying both the resistance means and the body engaging means which are required for exercising the various muscle groups of the body, the individual exercising machines are considerably more compact, are lighter weight and can be manufactured much more inexpensively. More particularly, each machine of the family of apparatus disclosed herein, includes a triangularly shaped, planar main frame of substantially identical design. The specific ancillary equipment required to accomplish the various muscle group exercises is operably associated with this standard main frame, or major structural component. In this way, manufacture and use of the machines is greatly facilitated.

Another important feature of certain embodiments of the present invention resides in the fact that, during their use, the resistance experienced by the trainee is varied in an optimum manner as the trainee moves the device through the exercise cycle. This is accomplished by changing the effective length of the lever arm through which the resistance is applied or through the use of cam arrangements located between the body engaging and resistance means of the apparatus.

While several variable resistance type exercise machines are known in the art, many embody complicated, multi-moving part mechanisms for interconnecting the body engaging elements of the device with the weights, springs or other resistance imparting means. Exemplary of such devices are those described in U.S. Pat. Nos. 3,905,599 issued to Mazman and in 3,858,873 to Jones.

In the apparatus of the present invention variable resistance is obtained using simple, straight forward mechanical arrangements for coupling the body engaging elements of the devices with the resistance means thereof.

Other unique features of the present invention will become apparent from the description which follows.

SUMMARY OF THE INVENTION

A further object of the invention is to provide apparatus of the type described herein in which the effective resistance experienced by the trainee varies as the device is moved through the exercise cycle. More particularly, in those forms of the invention in which the body engaging means, which are engaged by the trainee during exercising, comprise lever arms, the variation in resistance occurs because the effective length of the lever arms through which the resistance is applied continuously changes during the exercise cycle.

Another object of the invention is to provide an apparatus of the character described in the preceding paragraph in which the interconnection between the lever arms and the resistance means of the devices is extremely simple and embodies no moving parts.

A further object of the invention is to provide apparatus of the character described which is specially designed to avoid the strains, hazards, and balancing problems incident to the use of conventional prior art weight lifting apparatus.

Still another object of the invention is to provide apparatus of the class described in the preceding paragraphs which is simple and economical to construct and use, is dependable in operation, is of sleek, streamlined appearance, and is well adapted for group workouts under professional guidance.

BRIEF DESCRIPTION OF THE DRAWINGS

FIG. 1 is a side elevational view of one form of the Exercising Apparatus of the invention clearly illustrating the unique triangularly shaped main frame structure common to each of the embodiments of the invention.

FIG. 2 is a plan view of the form of the Exercising Apparatus shown in FIG. 1.

FIG. 3 is a front elevational view of the apparatus of FIG. 1.

FIG. 4 is an enlarged, foreshortened view taken along lines 4—4 of FIG. 1, partly in cross-section to show internal construction.

FIG. 5 is a cross-sectional view taken along lines 5—5 of FIG. 4.

FIG. 6 is a cross-sectional view taken along lines 6—6 of FIG. 4.

DESCRIPTION OF VARIOUS FORMS OF THE INVENTION

Figure 7:
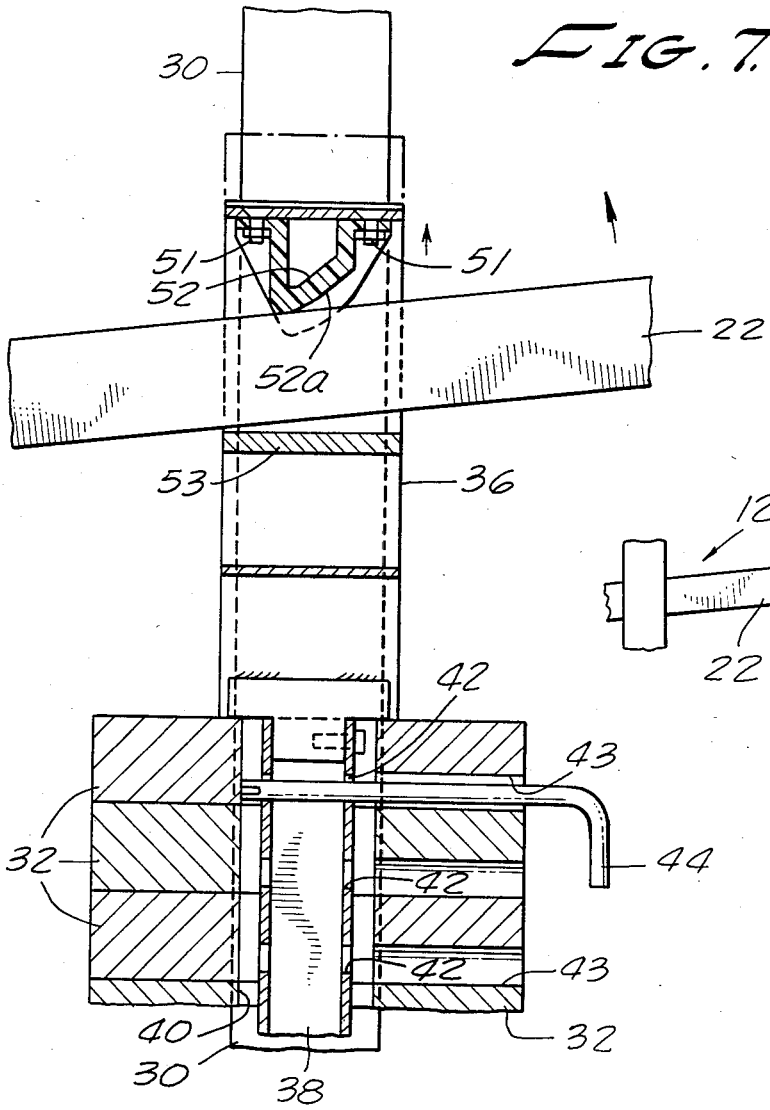
FIG. 7 is an enlarged fragmentary cross-sectional view taken along lines 7—7 of FIG. 4 illustrating the construction of the coupling means of this form of the invention which functions to operably couple the body engaging means and the resistance means of the invention.

Referring to the drawings, and particularly to FIGS. 1 through 6, one form of the exercising Apparatus of the invention is there illustrated. This form of the apparatus is ideally suited for exercise of the arm, shoulder and other upper body muscle groups of the body. As best seen in FIG. 1, the apparatus comprises a triangularly shaped main frame 12 including a first base member 14 adapted to engage a supporting surface, a generally vertically extending guide member 16 connected to base member 14 and an angularly extending member 18 interconnecting base member 14 and guide means 16. This interconnection is achieved at the upper end of the main frame by a top plate 20 (FIG. 2).

Body engaging means generally designated by the numeral 21 are carried by the main frame 12 for movement with respect thereto and for engagement by the user or trainee during the performance of exercises. Operably associated with the body engaging means 21 are resistance means movable relative to the guide means 16 for yieldably resisting movement of the resistance means in a first, or upward direction.

Referring to FIG. 2, it is important to note that in the unique construction of the main frame of the invention, the first base member 14 and the angularly extending member 18 are disposed in a co-planar relationship. That is, both members 14 and 18 are bounded by the same generally vertically extending planes.

In the form of the invention shown in FIGS. 1 through 6, the body engaging means comprises a pair of spaced apart lever arms 22 disposed on opposite sides of the planes defined by the edges of the base member 14 and the angularly extending member 18. Extending rearwardly, or to the left as viewed in FIG. 1, from angularly extending member 18 is a pivot support bracket 24 which is adapted to support an axle member 26 to which the lever arms 22 are pivotally connected. With this construction the lever arms 22 of the body engaging means are pivotally movable upwardly and downwardly with respect to the main frame 12 in the manner illustrated by the directional arrow shown in FIG. 1.

Disposed proximate one end of each of the lever arms 22 are engagement means, or handle bars, 28 adapted for engagement by the trainee. The lever arms 22 are operably coupled intermediate their ends with the resistance means through use of coupling means, the construction of which will presently be described. The coupling means function to interconnect the body engaging means and the resistance means so that the latter will yieldably resist movement of the body engaging means or engagement means 28 in a first upwardly direction.

In the form of the invention now being considered, the guide means 16 includes a pair of substantially vertically disposed guide elements, or rods, 30 (FIG. 3) located on either side of the plane of the base member 14 and the angularly extending member 18. Correspondingly, the resistance means of this form of the invention comprises a pair of spaced apart weight stacks made up of a plurality of individual weights 32.

The coupling means of the invention, which functions to interconnect the body engaging means and the resistance means (in this case the spaced apart weight stacks) includes a pair of first sleeve means 34 which are interconnected with the resistance means and are adapted for vertically reciprocal movement along the guide elements 30. Also forming a part of the coupling means is a pair of second sleeve means 36 which are interconnected to sleeves 34 and through which are received the lever arms 22 of the body engaging means of the invention. As will become apparent from the discussion which follows, the sleeve members 34 and 36 together comprise a pair of carriage-like assemblies which are vertically reciprocal relative to the guide elements 30 upon an upward force being exerted on the engagement means or handle bars 28 of the apparatus.

An important feature of the invention resides in the fact that the guide elements 30 not only function to guide vertical travel of the first sleeve means, but also function to guide the vertical travel of the weights 32 thereby eliminating the need for separate guide rods for the weights.

As best seen by referring to FIGS. 4, 5 and 6, the first sleeve means 34 are generally rectangular in shape and are connected to a pair of connecting columns 38 (FIG. 6) which extend downwardly of the weight stacks and which comprise portions of the resistance means of this form of the invention. These connecting columns 38 are closely receivable in apertures 40 formed in each of the weights 32 which make up the two weight stacks of the apparatus (FIG. 6). A plurality of vertically spaced apart key hole shaped apertures adapted to closely receive a locking pin 44 are formed along the entire length of each of the connecting columns 38. As indicated in FIG. 3, each of the weights 32 is also apertured at 43 to closely receive a locking pin 44. Apertures 42 in connecting column 38 are arranged to index with apertures 43 in weights 32 when the connecting columns are in their lower-most position. With this construction, pin 44 may be inserted into an aperture 43 of a selected weight 32 and will extend through the weight into the aperture 44 in the connecting column 38 which is aligned with the selected weight. In this way, one or more weights in each weight stack may readily be interconnected with the connecting column 38 so that as the carriage assemblies, made up of sleeves 34 and 36, are raised through exertion of an upward force on the handle bars 28, the weights within the respective weight stacks above the pin 44 will move upwardly relative to the main frame of the apparatus.

Another important feature of the present invention comprises a third guide means provided in the form of a pair of guide elements 48 (FIG. 6), for guiding the vertical travel of connector columns 38. In the present form of the invention the third guide elements 48 are disposed between the guide elements 30 and the connector columns 38 and each has a pair of vertically extending spaced apart channels 48*a* adapted to slidably receive inturned end portions 38*a* formed on the side walls of connector column 38. Although not shown in the drawings, other equivalent types of guide means such as cooperating rollers, slides and the like could, of course, also be used to operably guide the vertical travel of connector columns 38.

To lend stability to the apparatus of the present form of the invention, there is provided a second base member 50 which extends transversely of first base member 14 (FIG. 2). This transversely extending base member also functions to support the spaced apart weight stacks.

Referring now to FIG. 7, there is illustrated a novel and unique aspect of the invention, namely a fulcrum means adapted for slidable engagement with the lever arms 22 as the lever arms are moved in an upward first direction. In the present form of the invention, this unique fulcrum means comprises a pair of specially shaped engagement elements 52 which are carried bty sleeves 36. Each element 52, the unique crosssectional configuration of which is shown in FIG. 7, is preferably formed of a low surface friction material such as plastic, teflon or the like and is connected to sleeve 36 by means of appropriate fasteners such as 51. As indicated in FIG. 7, the novel configuration of elements 52 enables them to remain in continuous engagement with the lever arms 22 as the lever arms are moved pivotally upward relative to the guide elements 30. For example, when the lever arms are in the lower position indicated in FIG. 7, the upper surfaces of the lever arms are in engagement with the fulcrum elements 52 proximate their lower extremities. However, as the lever arms are moved upwardly by a force exerted in the direction indicated by the arrow in FIG. 7, the lever arms will reach a position wherein the upper surfaces thereof are engaging the flat portion of the element 52 (designated by the numeral 52*a* in FIG. 7). This continuous engagement of the lever arms with the fulcrum means provides for a smooth transitional movement as the lever arms move upwardly and provides the variable resistance aspect of the invention which results due to the continuous change in the effective length of the lever arms as they are moved upwardly relative to the guide elements 30. As indicated in FIG. 7, a lower supporting plate 53 is carried within each sleeve 36 in a spaced apart relationship with respect to element 52. Plate 53 is adapted to engage the lower surfaces of the lever arms to maintain them in proper position with respect to elements 52.

Also comprising a part of the embodiment of the invention shown in FIGS. 1 through 6 is a seating means for supporting the trainee in a seated position at a location in close proximity with the handle bars or grips 28. This seating means is here provided in the form of a seat element 56 which is supported on a vertical column 58 which in turn is carried by the base member 14.

In using the apparatus the trainee seats himself upon the seat 56, grips the elements 28 and then, using the upper body muscles, exerts an upward force on the handle bars causing the sleeve assemblies or carriages to move smoothly upwardly relative to each guide element 30. The continuous change in the length of the lever arms 22 as the levers move upwardly provides the variable resistance feature of the invention.

Figure 8:
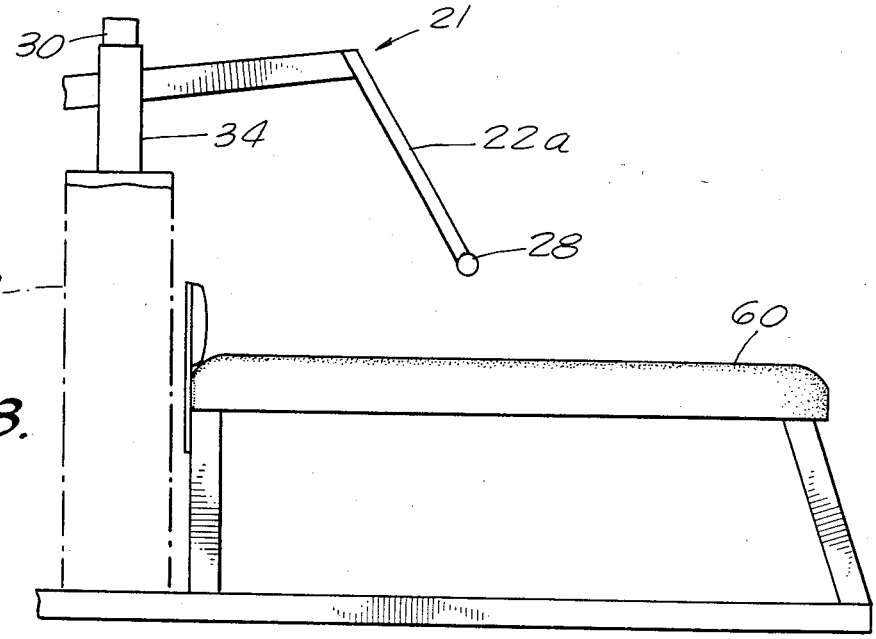
FIG. 8 is a fragmentary side elevational view of an apparatus similar to that shown in FIG. 1, but embodying an exercise bench and a grip member of a slightly different downwardly depending configuration.

It is, of course, readily apparent that the handlebar elements 26 could be extended either upwardly or downwardly and the seat portion raised, lowered or replaced with a bench-type structure to enable other exercises such as a supine press to be performed using the basic apparatus of the form illustrated in FIGS. 1 through 6. By way of example, such a modification is illustrated in FIG. 8 wherein the seat has been replaced with an exercise bench 60 and the body engaging means comprises spaced apart lever arms 22 having at one end downwardly depending grip or engagement portions 22*a*. The main frame and resistance means of this form of the invention is identical to that previously described.

Figure 9:
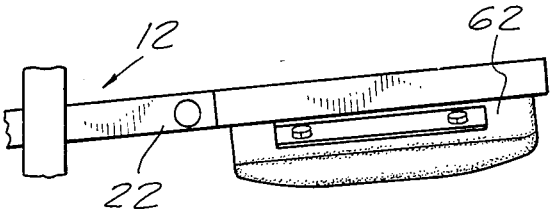
FIG. 9 is a fragmentary side elevational view of a portion of an apparatus similar to that shown in FIG. 1, but embodying padded shoulder engaging means in place of the handle bar like grip member.

It is also apparent that the handle bars 28, or 22*b*, could be replaced by padded members adapated to be engaged by the neck and shoulders of the trainee in the performance of squat-type exercises. Such a construction is illustrated in FIG. 9 wherein padded members 62 are provided proximate the ends of the lever arms 22 in place of the handle bar type elements depicted in FIGS. 1 and 8.

Figure 10:
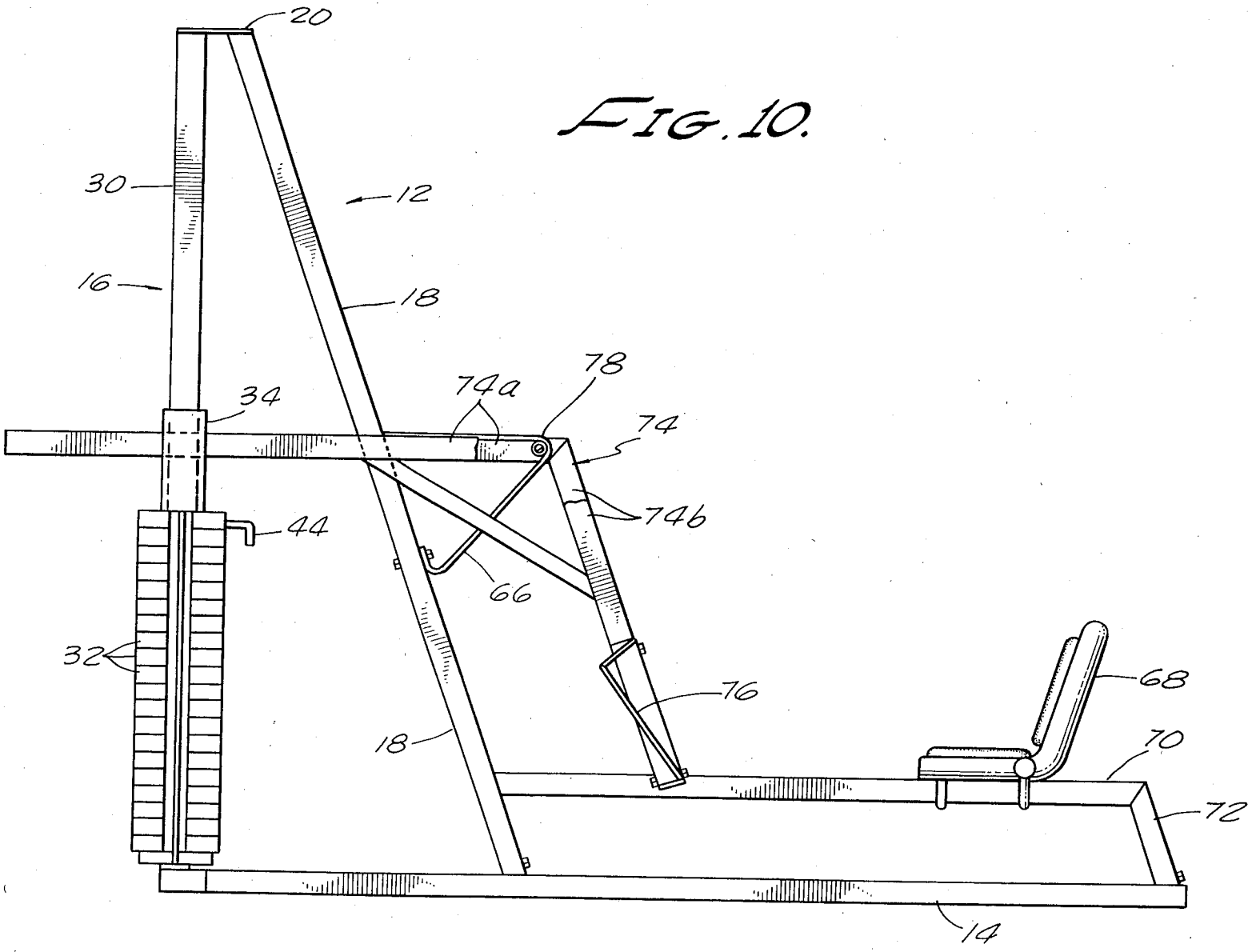
FIG. 10 is a side elevational view of another form of the Exercising Apparatus of the invention. In this form of the invention, which is adapted for exercise of the leg muscles, the trainee is positioned forwardly of the angularly extending member of the triangular main frame.
Figure 11:
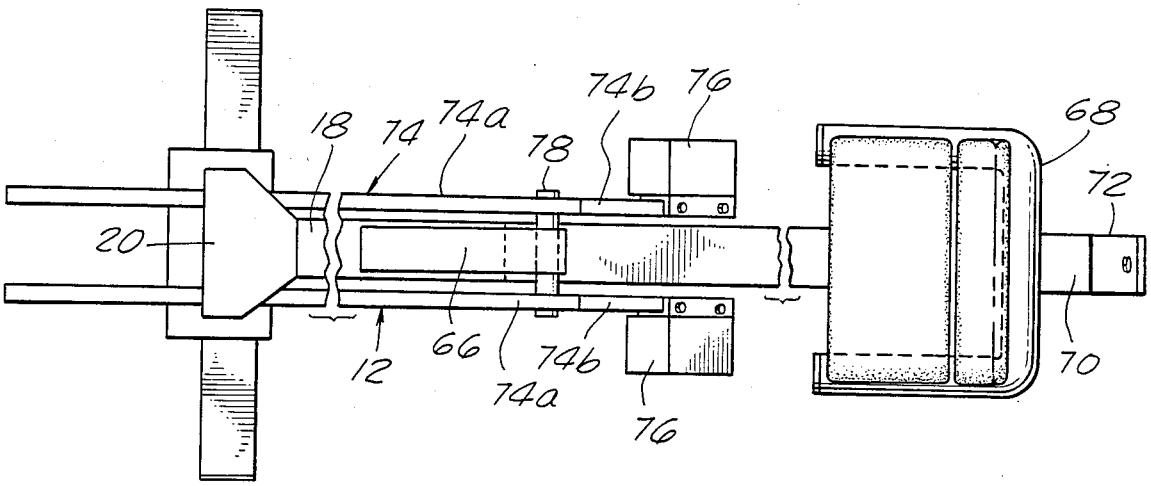
FIG. 11 is a fore-shortened plan view of the form of the invention shown in FIG. 10.

Referring now to FIGS. 10 and 11, another form of the exercising apparatus is thereshown. This form of the apparatus is particularly adapted for use in exercising the leg muscles of the body. The apparatus includes a main frame apparatus 12 of the identical configuration illustrated and described in FIG. 1, having a base member 14, a guide means 16 and an angularly extending member 18 interconnecting the base member and the guide means. The apparatus of FIGS. 10 and 11 also includes a pivot support bracket 66 which is similar in construction to pivot support bracket 24 of the embodiment shown in FIG. 1.

In the form of the invention illustrated in FIGS. 1 through 6, the trainee is positioned forwardly, or to the right of the guide means 16 and the weight stacks. However, in the form of the invention shown in FIGS. 10 and 11, the trainee is positioned forwardly, or to the right of the angularly extending member 18. In using the apparatus of FIG. 10, the trainee is disposed in a seated position and a seat arrangement 68 is provided for this purpose. Seat arrangement 68 is carried on a support member 70 which is spaced apart from, but extends generally parallel to, base member 14. One end of member 70 is affixed to angularly extending member 18 and the opposite end thereof is held in a spaced apart relationship with respect to base member 14 by a structural support member 72.

As can be observed by comparing FIGS. 1 and 10, the principal difference between the apparatus of these twoforms of the invention resides in the configuration of the body engaging means. While in the embodiment shown in FIG. 10, the body engaging means also comprises a pair of spaced apart lever arms 74 disposed on opposite sides of the angularly disposed member 18, it is differently configured in several respects. For example, the lever arms 74 include a first portion 74*a*, which extends toward the weight stacks and a second downwardly extending portion 74*b*. Located proximate the lower end of portion 74*b* are provided foot engaging means 76 for engagement by the feet of the trainee.

The body engaging means of this form of the invention as thus described is adapted for pivotal movement about a pivot axis designated in FIGS. 10 and 11 by the numeral 78 and portion 74*a* of the lever arm assembly is closely received through a second sleeve 36 which is connected to a first sleeve 34. These sleeves 34 and 36 are of identical configuration and perform the same function as those shown in FIGS. 1 through 6. Sleeve 34 is adapted for vertical reciprocal movement with respect to the guide elements 30 of the guide means 16 which are also of identical configuration to those previously described. This embodiment also includes a connecting column 38 of identical construction and purpose to that previously described which enables interconnection of one or more weights 32 of the two spaced apart weight stacks. These weight stacks and the weights 32 which make up the stacks also have a configuration identical to that previously described. Additionally included in this form of the invention are fulcrum means of a type previously described.

In using the exercising apparatus illustrated in FIGS. 10 and 11, the trainee is seated upon seat assembly 68 with his feet placed on the foot engaging means, or foot plates, 76. With the apparatus at rest, the legs of the trainee are bent so that when the legs are straightened, a force is exerted on the foot plates 76 in the direction of the weight stacks causing the body engaging means, or lever arms 74, to pivot about point 78. This results in the upward movement of the free ends of portion 74*a* of the lever arms, which in turn urges upward movement of the sleeves 34 and 36, which comprise the two reciprocal carriages of the invention. Since the connecting column which depends through the weight stack is interconnected with sleeve 34, the connecting column, along with the weights connected thereto by means of connecting pin 44, will move in an upwardly direction relative to the guide elements 30 as the ends 74*a* of the lower arms move upwardly. As was the case in the earlier described embodiment of the invention, as the portion 74*a* of the lever arms moves upwardly, the effective length of the lever arm acting upon the resistance means will continuously change, thereby providing the variable resistance feature of the apparatus.

It is important to note that in the form of the invention shown in FIGS. 10 and 11, the main superstructure, the resistance means, and the coupling means are substantially identical. The only differences between the embodiments of the invention reside in the position of the trainee relative to the main frame and the construction of the body engaging means, or lever arm assembly 74.

Figure 12:
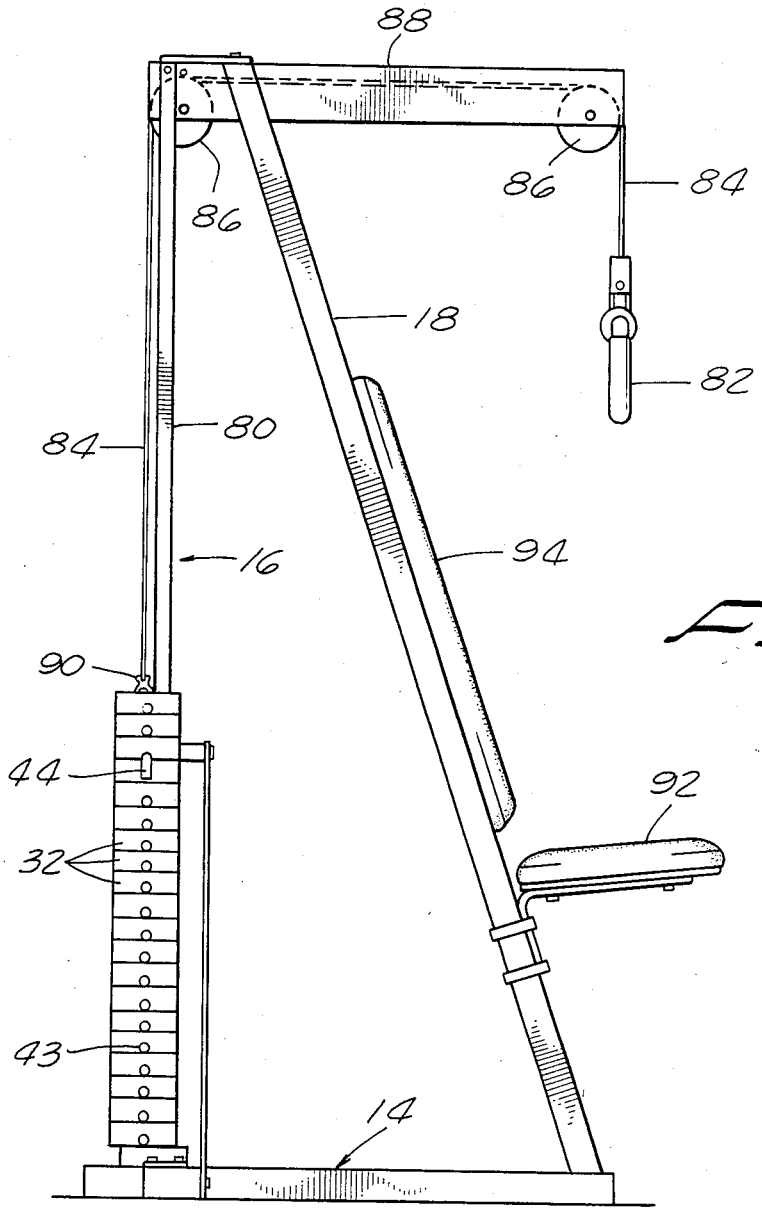
FIG. 12 is a side elevational view of yet another form of the Exercising Apparatus of the invention. In this form of the invention the body engaging means is interconnected with the resistance means through a pulley and cable arrangement.

Referring now to FIG. 12 of the drawings, yet another form of the apparatus of the invention is thereshown. In this form of the apparatus, the generally triangularly shaped main frame assembly comprises a base member 14, guide means 16 and an angularly disposed member 18, all of which are disposed in a co-planar relationship, that is, all of which are disposed in a substantially vertically extending plane. Unlike the form of the invention illustrated and described previously, the guide means 16 comprises a single guide element 80, rather than a pair of spaced apart guide elements. Similarly, in this form of the invention only a single weight stack is provided, with the individual weights thereof being guided for vertical travel by the single guide element 80.

The body engaging means of the embodiment of the invention shown in FIG. 12 comprises gripping means in the form of at least one gripping element 82 adapted to be gripped by the trainee and interconnecting means for interconnecting the gripping means and the resistance means. The interconnecting means comprises an elongated cable 84, one end of which is attached to the gripping element 82 and the other end of which is attached to a connecting column which is of a design similar to that illustrated and described in FIGS. 1 through 11. Cable 84 passes over a pair of spaced apart pulleys 86 which are rotatably carried by a horizontally extending member 88 which is connected to, and cantilevers forwardly of, the main frame assembly. After passing over pulley 86, cable 84 extends downwardly for interconnection with the connecting column at a point designated in FIG. 12 by the numeral 90.

In operation of the apparatus illustrated in FIG. 12, the trainee sits on a seat portion 92 which is affixed proximate the lower extremity of angularly extending member 18. The trainee then leans rearwardly, resting his back against a back support 94 which is carried by angularly extending member 18 intermediate its ends. In this position, by raising his arms, the trainee can grip the gripping element 82 and exert a downward force thereupon. This results in a upward force being exerted on the connecting column. Since the individual weights 32 can be interconnected with the connecting column by the connecting pin 44 in the same manner previously described herein, a downward force exerted on the gripping elements 82 will cause upward movement of the connecting column and the weights 32 which are interconnected therewith. For example, in the illustration of the apparatus in FIG. 12, upward movement of the connecting column would cause concomitant upward movement of the top three weights 32 of the weight stack.

A guide element 48, similar in configuration to that shown in FIG. 6, guides the upward travel of the connector column 38. Once again, it is important to note that the novel configuration of the guide element 80 and of the apertured weights 32 permits the single central guide column 80 to guide the travel of the weights without the necessity of providing separate guide rods for guiding the vertical travel of the weights.

Figure 13:
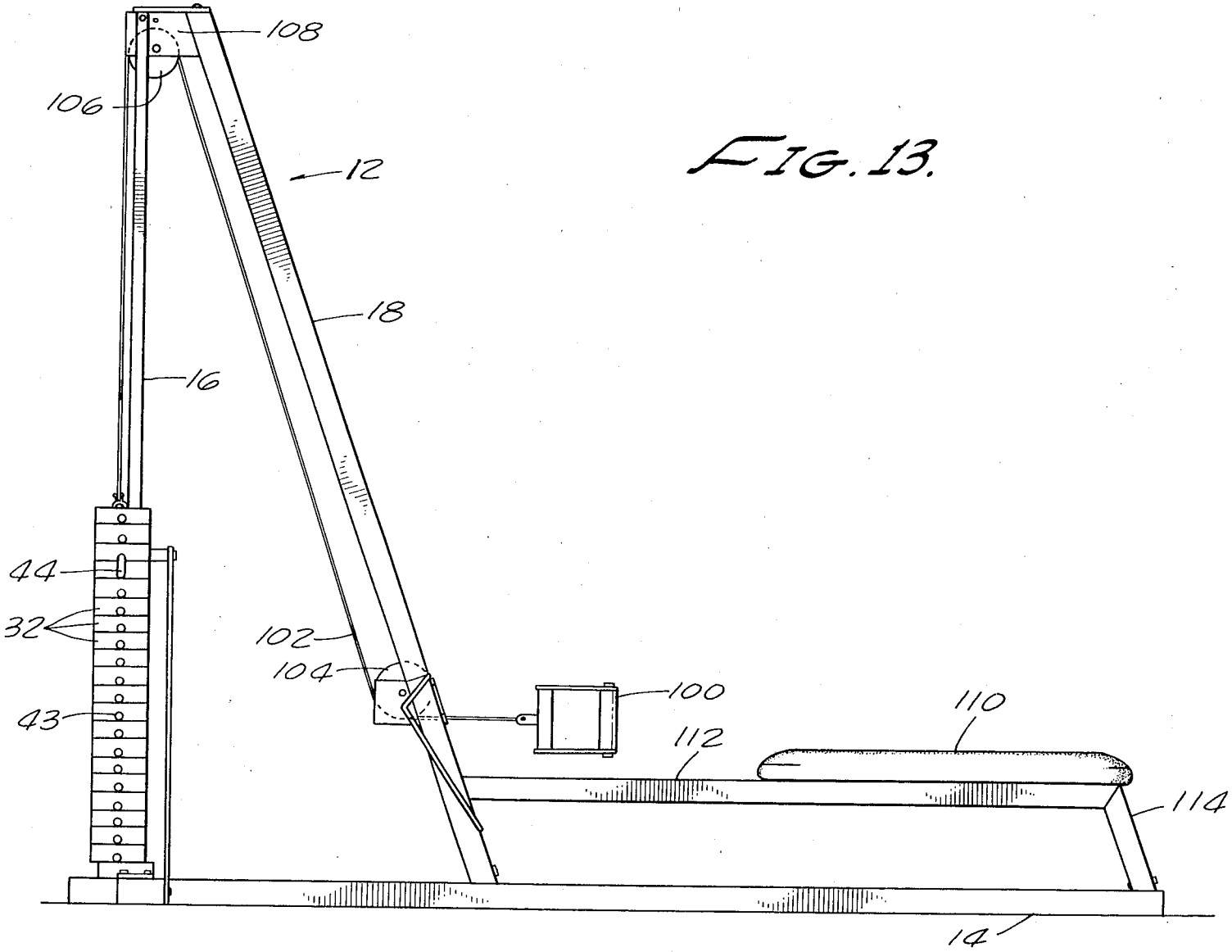
FIG. 13 is a side elevational view of yet another form of the exercising apparatus of the invention.

Turning to FIG. 13, there is illustrated still another form of the invention which is similar to that illustrated in FIG. 12. In this form of the invention, the base member 14, the guide member 16 and the angularly disposed member 18 are also disposed in a co-planar relationship. As in the embodiment of the invention shown in FIG. 12, the body engaging means includes at least onegripping element 100, which is interconnected with the resistance means by a cable 102 which passes under a pulley 104, over a pulley 106 and then downwardly for interconnection with a connecting column 38 of a configuration identical to that previously described. Pulley 104 is rotatably carried by the main frame at a point proximate the lower end of member 18 while pulley 106 is rotatably carried by a bracket 108 provided proximate the apex, or upper end, of the triangularly shaped main frame 12.

In using the apparatus shown in FIG. 13, the trainee is positioned on a bench arrangement similar to that shown in FIG. 10 having a seat portion 110 being supported on a horizontally extending support member 112 which is disposed in a parallel spaced apart relationship with the base member 14. One end of support member 112 is connected to angularly disposed member 18 and the opposite end thereof is held in a fixed position relative to base member 14 by a support element 114. With the trainee positioned on seat portion 110, he can grip the gripping element 100 and, with a rowing type movement, can pull the gripping elements 100 in a direction away from the main frame 12. Such a force exerted on the gripping elements will cause the connector column and the weights which are connected thereto by connecting pin 44 to move in an upwardly direction. The connecting column and the weights are guided for reciprocal travel by the guide means 16 in the same manner as described in connection with the apparatus illustrated in FIG. 12.

Once again it is to be noted that the basic main frame and the resistance means of the embodiment of the invention shown in FIG. 13 are substantially identical to those found in the forms of the invention previously described herein. Therefore, it is apparent that a very important aspect of the invention resides in the triangularly shaped main frame and in the configuration and operation of the resistance means of the invention.

While the guide means of the main frame is provided in the form of spaced apart guide elements 30 in the form of the inventions shown in FIGS. 1 through 10, it is apparent that the single element co-planar configuration shown in FIGS. 12 and 13 could be used in these previously described forms of the invention by simple modification of the apparatus.

Figure 14:
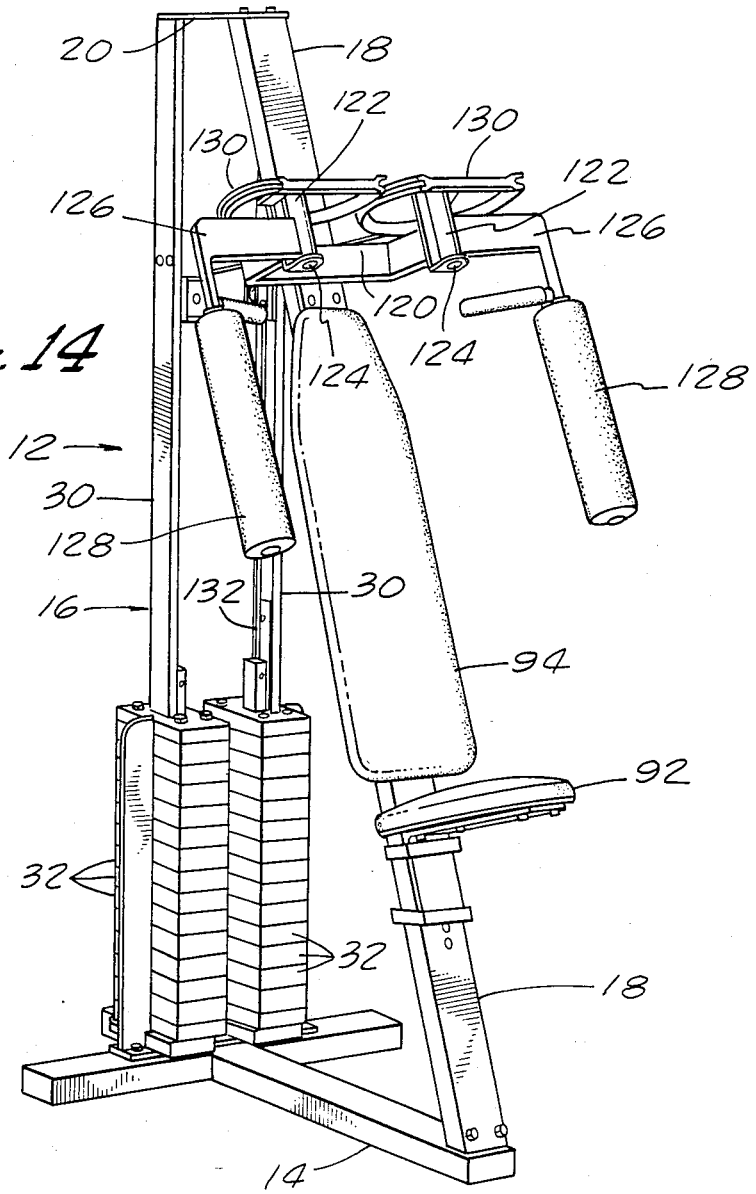
FIG. 14 is a generally perspective view of still another form of the apparatus of the invention adapted for exercising the upper body muscle groups.

Turning now to FIGS. 14 through 18, there is illustrated still another form of exercising apparatus of the invention. As best seen by referring to FIG. 16, the apparatus of this embodiment of the invention also includes a main frame assembly 12 of the general configuration previously described. As illustrated in FIG. 14, the main frame comprises a base member 14, a guide means 16 and an angularly disposed member 18 interconnecting the base member and the guide means. In this form of the invention, the guide means takes the form of a pair of vertically extending, spaced apart guide elements 30 of the same general configuration and arrangement as that shown in FIGS. 1 through 6.

A pair of spaced part weight stacks comprising a plurality of weights 32 are adapted to move reciprocally relative to guide element 30 in the same manner as described in connection with the embodiment shown in FIGS. 1 through 6. Additionally, individual weights 32 are interconnected with the body engaging means by means of a guide column and locking pin arrangement identical to that previously described. Accordingly a discussion of this operation will not be repeated.

As was the case in the form of the invention illustrated in FIG. 12, interconnecting means are used to interconnect the body engaging means with the resistance means, or in this case, with the connecting column to which the weights are interconnected by means of a connecting pin. The present form of the invention also includes a seat element 92 and a back rest 94 carried by the angularly extending member in a manner and a location similar to that described in connection with the embodiment of the invention shown in FIG. 12.

Figure 18:
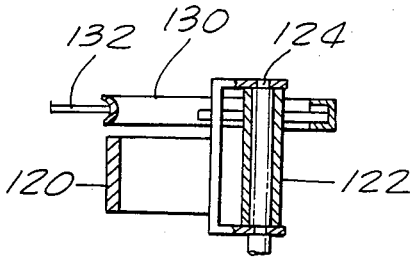
FIG. 18 is a fragmentary view taken along lines 18—18 of FIG. 15.

The principal difference between the apparatus of the invention shown in FIGS. 14 through 18 and the previously described apparatus resides in the configuration and operation of the body engaging means. In this latest form of the invention, the body engaging means comprises a support member 120 extending transversely of angularly extending member 18 (FIG. 14). Carried proximate the end portion of support member 120 are axle supporting means shown here in the form of bushing assemblies 122 adapted to carry axles 124 (FIG. 18). Also forming a part of the body engaging means is a pair of lever assemblies carried by each of the axles 124 for rotational movement with respect to member 120. The lever assemblies 126 include downwardly depending engagement portions 128 adapted to be engaged by the trainee when seated on seat 92. Interconnecting means are provided for interconnecting each lever assembly 126 with the resistance means whereby the resistance means will yieldably resist rotational movement of each of the lever assemblies 126 when the trainee attempts to rotate them in a first direction.

Each of the lever arm assemblies 126 also includes cam means shown here in the form of curved cable guide elements 130 which are connected to, and rotatable with, their respective lever assemblies 126. The interconnecting means of the invention comprises a pair of elongated cables 132 (FIGS. 15 and 17), one end of which is connected to the cable guide, or cam element 130 and the other end of which is connected to the connector column 38.

Figure 15:
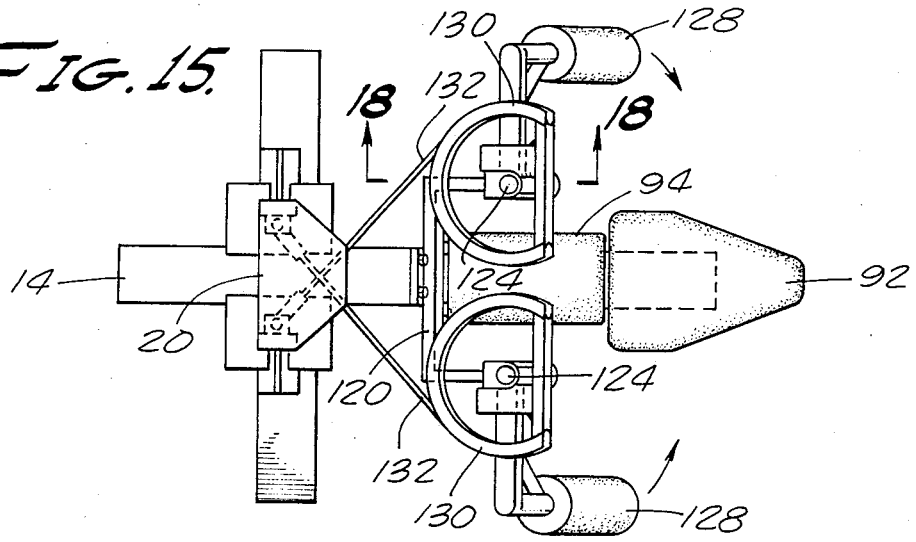
FIG. 15 is a plan view of the apparatus of the invention illustrated in FIG. 14.
Figure 16:
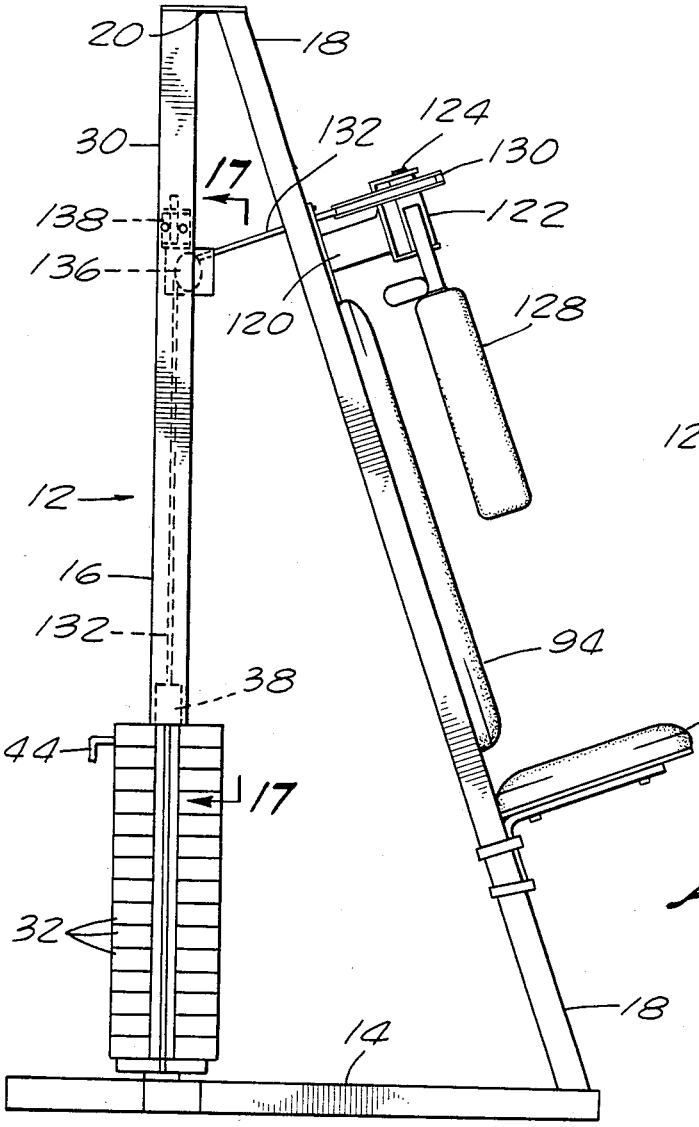
FIG. 16 is a side elevational view of the form of the exercising apparatus of the invention shown in FIG. 14.
Figure 17:
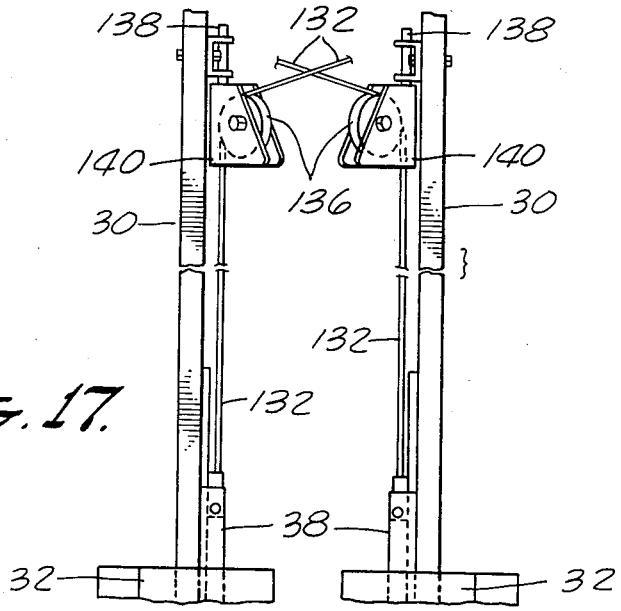
FIG. 17 is a fragmentary view taken along lines 17—17 of FIG. 16.

Referring particularly to FIGS. 15 and 17, cables 132 extend from elements 130, to which they are connected, in a crossing relationship and pass around pulleys 136 which are rotatably carried by guide elements 30. Brackets 138 serve to interconnect pulley housings 140 with each of the guide columns. After passing around their respective pulleys 136, cables 132 depend downwardly for interconnection with connecting columns 38 to enable interconnection of the cables with one or more of weights 32 carried in the weight stacks of the apparatus.

In operation, the trainee sits upon seat 92 and leans back against back rest 94. In this position, he can grip gripping elements 128 and, by exerting a force in the direction of the arrows of FIG. 15, move the cable elements 130 in a direction tending to wrap the cables 132 therearound. This movement causes connector columns 38 to move in an upwardly direction and carry with them one or more of the weights 32 which have been connected thereto by the connecting pin. This butterfly-type exercise by the trainee is used to exercise the muscles of the upper body. The unique configuration of the cam elements of 130 provide the variable resistance feature of the apparatus of this form of the invention.

It is to be understood that various modifications to the form of the apparatus shown in FIGS. 14 through 17 can be made to accomplish pull-over or other types of exercises wherein the axis of rotation of the apparatus is in general alignment with the axis of rotation of the parts of the body being exercised. For example, by simple modification, the axles 124 can be arranged to extend along a generally horizontally extending axis with the cable elements being disposed in spaced apart generally vertical planes. By then relocating the gripping elements such that the trainee can pull in a downward direction, that is, with a "pull-over" type motion, rotation of the cam element 130, will cause the cable to wind thereabout against the resistance of the resistance means to which the cable is interconnected.

Similarly, the lever arms can be reconfigured such that the axles 124 are disposed in a plane substantially perpendicular to the plane of angularly extending member 18. With this arrangement, the cam elements will be disposed in a plane substantially parallel to the plane of angularly disposed member 18. Relocation of the gripping elements to a position on either side of the set assembly will enable the trainee to exert a rotational movement of the cam elements against the resistance of one or more weights in the weight stack and will enable the performance of yet another "push-out" type exercise for exercising the muscles of the upper body. Additionally, chains, belts or other devices can function as interconnecting means in lieu of cables.

In summary, by simply reconfiguring the lever arm assemblies and the plane in which the axles 124 reside, several different types of rotational movement can be achieved to enable various types of butterfly, pull-over and push-out type exercises for the muscles of the upper body. Once again, it is to be understood and appreciated that the basic main frame and resistance means construction of the invention remains unchanged. Only the body engaging means of the invention is modified to accomplish the wide range of upper body portion exercises.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An exercising apparatus, comprising:

(a) a triangularly shaped main frame including a base member adapted to engage a supporting surface, a generally vertically extending guide means connected to said base member and an angularly extending member interconnecting said base member and said guide means; said base member and said angularly extending member being disposed in a coplanar relationship;

(b) body engaging means carried by said main frame for movement with respect thereto for engagement by the user during the performance of exercises, said body engaging means comprising a pair of spaced apart lever arms disposed on opposite sides of the plane of said base member and said angularly extending member, said lever arms being pivotally connected to said angularly extending member and having proximate one end thereof engagement means for engagement by the trainee; and (c) resistance means movable relative to said guide means and operably associated with said body engaging means for yieldably resisting movement thereof in a first direction, said resistance means being operably coupled with said lever arms intermediate their ends by coupling means, whereby said resistance means will yieldably resist movement of said engagement means in a first direction.

2. An apparatus as defined in claim 1 in which said guide means includes a pair of substantially vertically disposed guide elements located on either side of the plane of said base member and said angularly extending member and in which said coupling means comprises a pair of first sleeve means interconnected with said resistance means and adapted for reciprocal movement relative to said guide elements of said guide means and a pair of second sleeve means interconnected with said first sleeve means for receiving therethrough said lever arms of said body engaging means.

3. An apparatus as defined in claim 2 in which each of said second sleeve means carries a fixedly mounted fulcrum means for engagement with said lever arms as said lever arms are moved in an upward first direction.

* * * * *